US008505606B2

(12) United States Patent
Wu

(10) Patent No.: US 8,505,606 B2
(45) Date of Patent: Aug. 13, 2013

(54) ROTATABLE KNOB CONTROLLED ADHESIVE TAPE DISPENSER

(75) Inventor: Chien-Lung Wu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 511 days.

(21) Appl. No.: 12/459,638

(22) Filed: Jul. 6, 2009

(65) Prior Publication Data

US 2011/0000623 A1 Jan. 6, 2011

(51) Int. Cl.

| | |
|---|---|
| ***B32B 37/26*** | (2006.01) |
| ***B26F 3/02*** | (2006.01) |
| ***B43L 19/00*** | (2006.01) |

(52) U.S. Cl.

USPC ..... 156/577; 156/523; 156/527; 156/579; 118/76; 118/200; 118/257; 242/588; 242/588.3; 242/588.6; 242/160.2; 242/160.4; 206/411; 401/110; 401/116

(58) Field of Classification Search

USPC ..... 156/523, 527, 538, 540, 547, 577, 156/579; 118/76, 200, 257; 225/46; 242/160.2, 160.4, 170, 171, 588, 588.2, 242/588.3, 588.6; 206/411; 401/110, 111, 401/112, 116

See application file for complete search history.

(56) References Cited

U.S. PATENT DOCUMENTS

| | | | | |
|---|---|---|---|---|
| 3,792,931 | A * | 2/1974 | Ganz | 401/109 |
| 4,786,197 | A * | 11/1988 | Koeln et al. | 401/116 |
| 5,092,701 | A * | 3/1992 | Lai | 401/107 |
| 6,951,431 | B2 * | 10/2005 | Rollion | 401/117 |
| 7,654,291 | B2 * | 2/2010 | Miyajima et al. | 141/63 |
| 2006/0257195 | A1 * | 11/2006 | Chen | 400/697 |
| 2009/0159217 | A1 * | 6/2009 | Sun | 156/540 |
| 2009/0183838 | A1 * | 7/2009 | Ushijima | 156/538 |
| 2009/0229763 | A1 * | 9/2009 | Lin | 156/577 |

FOREIGN PATENT DOCUMENTS

JP 2005001850 A * 1/2005

* cited by examiner

*Primary Examiner* — Mark A Osele
(74) *Attorney, Agent, or Firm* — William E. Pelton, Esq.; Cooper & Dunham LLP

(57) ABSTRACT

An adhesive tape dispenser has a body, an adhesive tap dispensing unit, a knob, a pushing element and a resilient element. The adhesive tape dispensing unit is mounted in the body. The knob is mounted rotatably on the body and has a guiding structure formed obliquely on the knob and having two ends each having a limiting capability to restrict a rotating range of the knob relative to the body between the ends of the guiding structure. The pushing element is mounted slidably in the body, is connected between the knob and the adhesive tape dispensing unit and has a guided structure connected slidably to slide along the guiding structure on the knob when the knob is rotated. The resilient element is mounted in the body to provide a recoil force to the adhesive tape dispensing unit.

18 Claims, 9 Drawing Sheets

ROTATABLE KNOB CONTROLLED ADHESIVE TAPE DISPENSER

BACKGROUND OF THE INVENTION

1. Field of the Invention

The present invention relates to a dispenser, and more particularly to an adhesive tape dispenser controlled by a rotatable knob.

2. Description of Related Art

An adhesive tape dispenser is used to dispense an adhesive tape, such as a correction tape onto a paper or the like. Taiwan Utility Model No. M3457 17 discloses a conventional adhesive tape dispenser comprising a body, an adhesive tape dispensing unit and a driving unit. The driving unit comprises a knob and a pushing rod. The knob is mounted rotatably on the body and has multiple oblique tracks formed on the knob in alternative and connected with each other. The pushing rod has a block formed on the pushing rod and attached slidably to the tracks on the knob. When the knob is rotated, the block will be moved along the oblique tracks on the knob to push the pushing rod to move relative to the body. Consequently, pushing rod will push the adhesive tape dispensing unit to protrude out of the body to allow a user to dispense the adhesive tape onto a paper.

The oblique tracks are formed continuously on the knob in alternative, so the knob is rotated relative to the body in 360°. Therefore, the curvature of each track on the knob of the conventional dispenser is less then 90°, such that a large force is needed to rotate the knob for pushing the pushing rod and the dispensing unit to move and the operation of the conventional dispenser is laborious. In addition, the oblique tracks are connected continuously with each other in alternative, so the conjunction between adjacent tracks does not have a limiting capability. Therefore, the knob is easily rotated overly, and the dispensing unit cannot be well positioned at the extension condition for use.

To overcome the shortcomings, the present invention tends to provide an adhesive tape dispenser to mitigate or obviate the aforementioned problems.

SUMMARY OF THE INVENTION

The main objective of the invention is to provide an adhesive tap dispenser that is well-positioned and convenient in use and has a labor-saving capability.

The adhesive tape dispenser has a body, an adhesive tap dispensing unit, a knob, a pushing element and a resilient element. The adhesive tape dispensing unit is mounted in the body. The knob is mounted rotatably on the body and has a guiding structure formed obliquely on the knob and having two ends each having a limiting capability to restrict a rotating range of the knob relative to the body between the ends of the guiding structure. The pushing element is mounted slidably in the body, is connected between the knob and the adhesive tape dispensing unit and has a guided structure connected slidably to slide along the guiding structure on the knob when the knob is rotated. The resilient element is mounted in the body to provide a recoil force to the adhesive tape dispensing unit.

Other objects, advantages and novel features of the invention will become more apparent from the following detailed description when taken in conjunction with the accompanying drawings.

DETAILED DESCRIPTION OF PREFERRED EMBODIMENT

Figure 1:
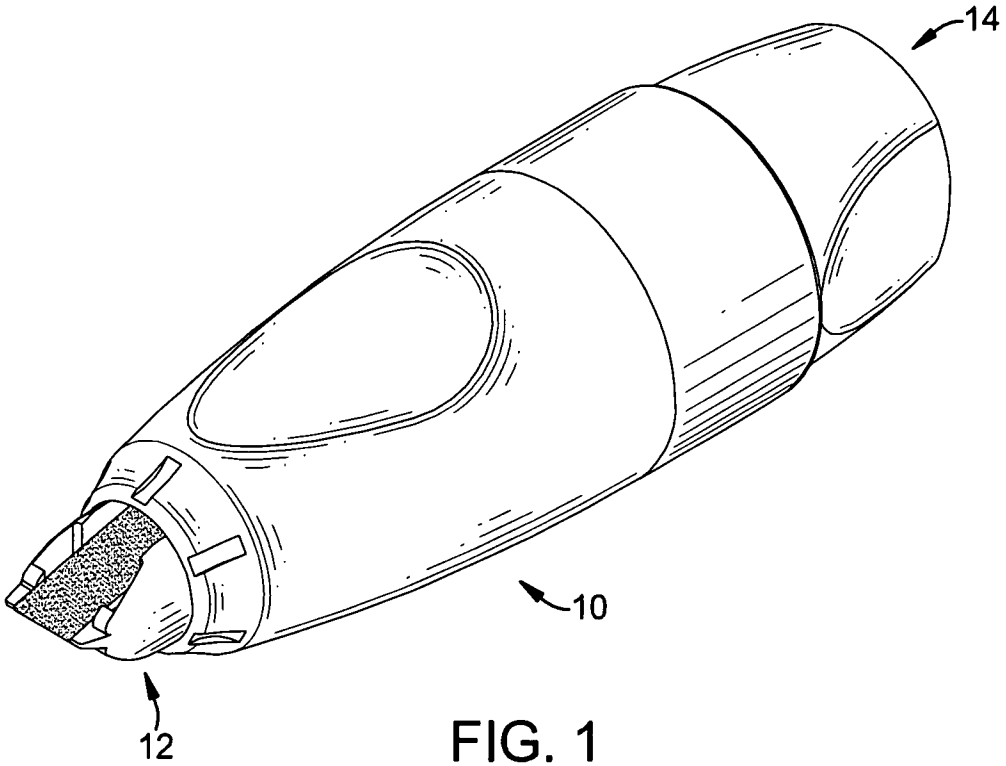
FIG. 1 is a perspective view of a first embodiment of an adhesive tape dispenser in accordance with the present invention.
Figure 2:
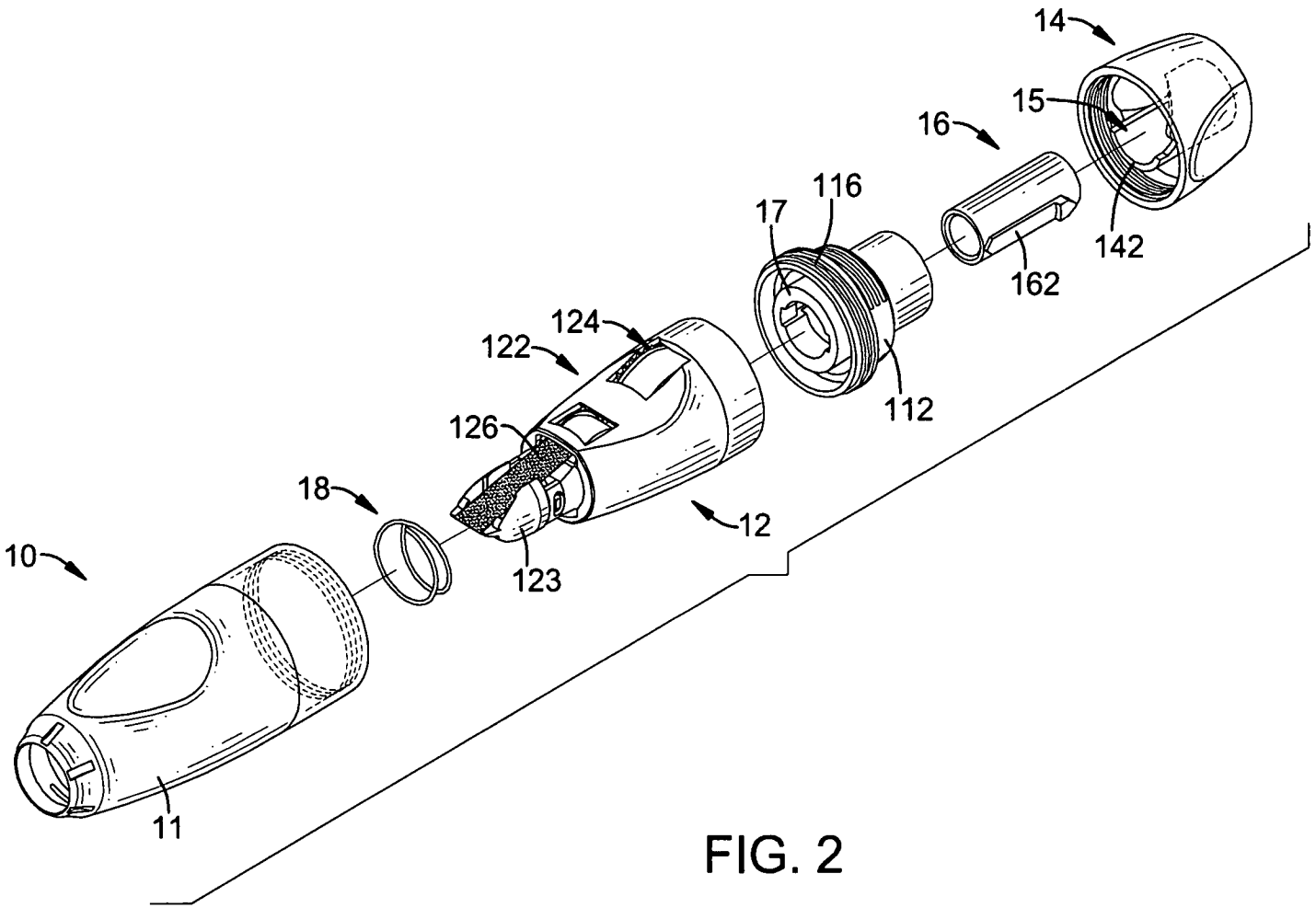
FIG. 2 is an exploded perspective view of the dispenser in FIG. 1.
Figure 3:
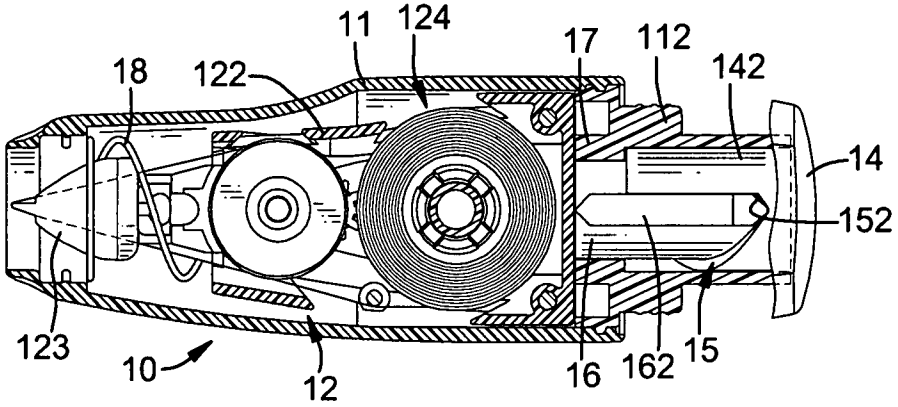
FIG. 3 is a side view in partial section of the dispenser in FIG. 1.

With reference to FIGS. 1 to 3, a first embodiment of an adhesive tape dispenser in accordance with the present invention comprises a body (10), an adhesive tape dispensing unit (12), a knob (14), a pushing element (16) and a resilient element (18).

The body (10) is hollow and may be composed of two housings (11, 112) combined detachably with each other to define a chamber in the body (10) for holding the remaining elements of the dispenser inside. In the first embodiment, the body (10) is composed of a front housing (11) and a rear housing (112) detachably combined with the front housing (11) with threads (116). Accordingly, the body (10) is detachable to replace the parts held inside the body (10). In addition, a sleeve (17) is held in the body (10) and may be formed integrally on the rear housing (112).

The adhesive tape dispensing unit (12) is mounted in the chamber of the body (10) and comprises a bracket (122), a supplying wheel assembly (124) and an adhesive tape (126). The bracket (122) is provided with a dispensing head (123) that can protrude from one end of the body (10). The supplying wheel assembly (124) is mounted operationally in the bracket (122). The adhesive tape (126) may be a correction tape, a stick tape or the like and is mounted in the bracket (122) and around the dispensing head (123) and the supplying wheel assembly (124). The structure and operation of the adhesive tape dispensing unit (12) may be conventional, so detail description of the dispensing unit (12) is omitted.

Figure 4:
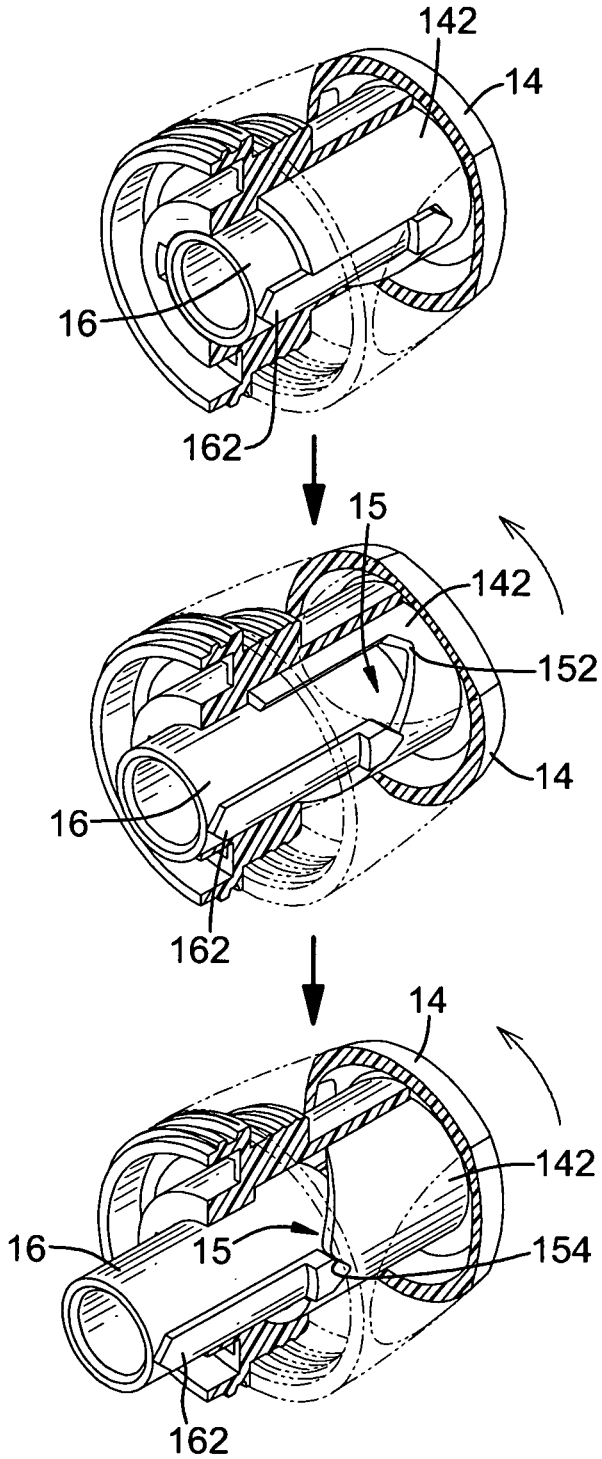
FIG. 4 shows operational perspective views in partial section of the knob and the pushing element of the dispenser in FIG. 1.

With further reference to FIG. 4, the knob (14) is hollow, is mounted rotatably on the body (10) at one end opposite to the end from which the dispensing head (123) protrudes and has an end, a cavity, a guiding structure (15) and an optional guiding tube (142). The cavity is defined in the end of the knob (14) and has a bottom. The guiding tube (142) is formed on and protrudes from the bottom of the cavity. The guiding structure (15) is formed obliquely on the knob (14), may be formed on the guiding tube (142) and may be a guiding cavity with an oblique inner side defined in the knob (14). In an alternative embodiment, the guiding structure (15) may be formed on an inner surface of cavity of the knob (14). The guiding structure (15) has two ends each having a limiting capability to restrict a rotating range of the knob (14) relative to the body (10) between the ends of the guiding structure (15). The ends of the guiding structure (15) correspond respectively to a retracted position and an expanded position of the dispensing unit (12). The guiding structure (15) obliquely extends 90° to 360° in curvature. In a preferred embodiment, the guiding structure (15) extends 180° to 360° in curvature and may extend 180° in curvature. The guiding structure (15) may further have two positioning recesses (152,154) defined respectively in the ends of the guiding structure.

The pushing element (16) is mounted slidably in the body (10), may be a rod and mounted slidably through the sleeve (17), is connected between the knob (14) and the adhesive tape dispensing unit (12) and has a guided structure (162). The guided structure (162) is connected slidably to the guiding structure (15) on the knob (14) to slide along the guiding structure (15) when the knob (14) is rotated. The guided structure (162) may be a protrusion, a rib or a block formed on the pushing element (16), abutting slidably with the guiding structure (15) and may be held in one of the positioning recesses (152,154) of the guiding structure (15) to hold the dispensing unit (12) at the retracted or expended position.

The resilient element (18) is mounted in the body (10) to provide a recoil force to the adhesive tape dispensing unit (12) and may be a spring. In the first embodiment, the resilient element (18) is held in the body (10) and has an end mounted around one end of the adhesive tape dispensing unit (12).

With reference to FIGS. 3 and 4, when the guided structure (162) is held on the end of the guiding structure (15) corresponding to the retracted position or held in the positioning recess (152) of the guiding structure (15), the dispensing unit (12) is completely retracted into the body (10).

Figure 5:
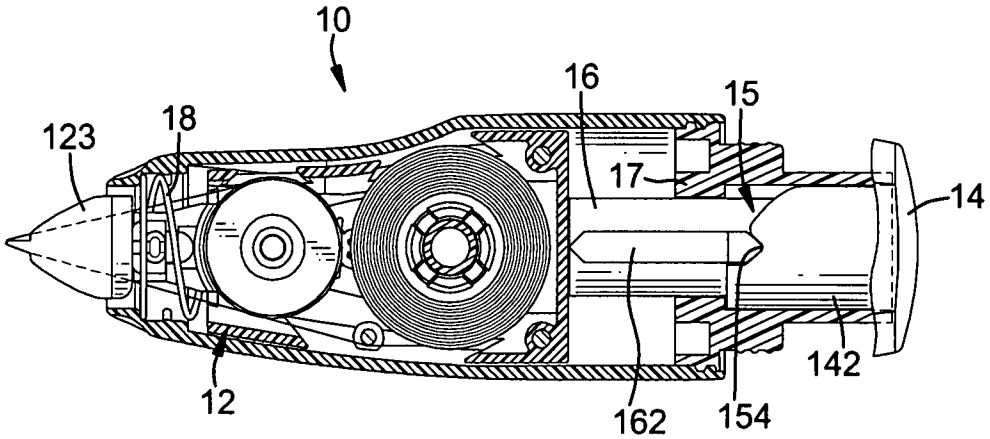
FIG. 5 is an operational side view in partial section of the dispenser in FIG. 1.

With further reference to FIG. 5, when the knob (14) is rotated, the guided structure (162) is pushed to slide along the guiding structure (15) to make the pushing element (16) moving relative to the body (10). Consequently, the pushing element (16) pushes the dispensing unit (12) to make the dispensing head (123) protruding out of the body (10), such that a user can dispense the adhesive tape (126) onto a paper or any desired location. At this time, the guided structure (162) may be held in the positioning recess (154) of the guiding structure (15) to provide a positioning effect to and keep the dispensing unit (12) at the expanded position.

When the knob (14) is rotated in reverse, the dispensing unit (12) and the pushing element (16) will be moved backward with the recoil force provided by the resilient element (18). The guided structure (162) will move along the guiding structure (15) to the end corresponding to the retracted position.

Because the guiding structure (15) on the knob (14) has a large curvature more than 90°, so the guiding structure (15) is a slope smoother then that of a conventional one such that a small force is needed for pushing the dispensing unit (12) out of the body (10). Therefore, the operation of the dispenser in accordance with the present invention is laborsaving. In addition, because the ends of the guiding structure (15) have limiting capabilities, the rotating range of the knob (14) is limited between the ends of the guiding structure (15) to allow the knob (14) being rotated only in a limited angle range. Accordingly, overly rotating the knob (14) can be completely prevented, and the dispensing unit (12) is well positioned and the operation of the dispenser is easily controllable and convenient.

Figure 6:
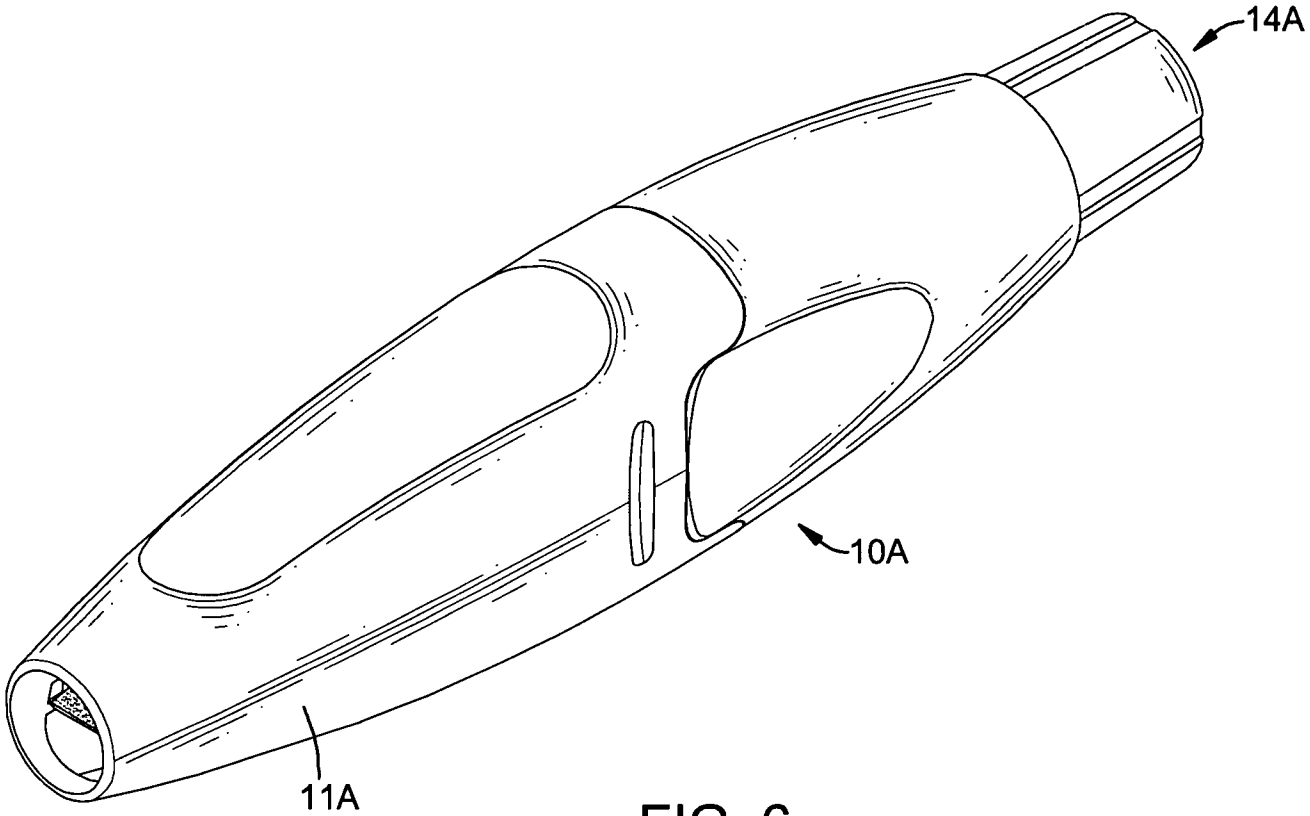
FIG. 6 is a perspective view of a second embodiment of an adhesive tape dispenser in accordance with the present invention.
Figure 7:
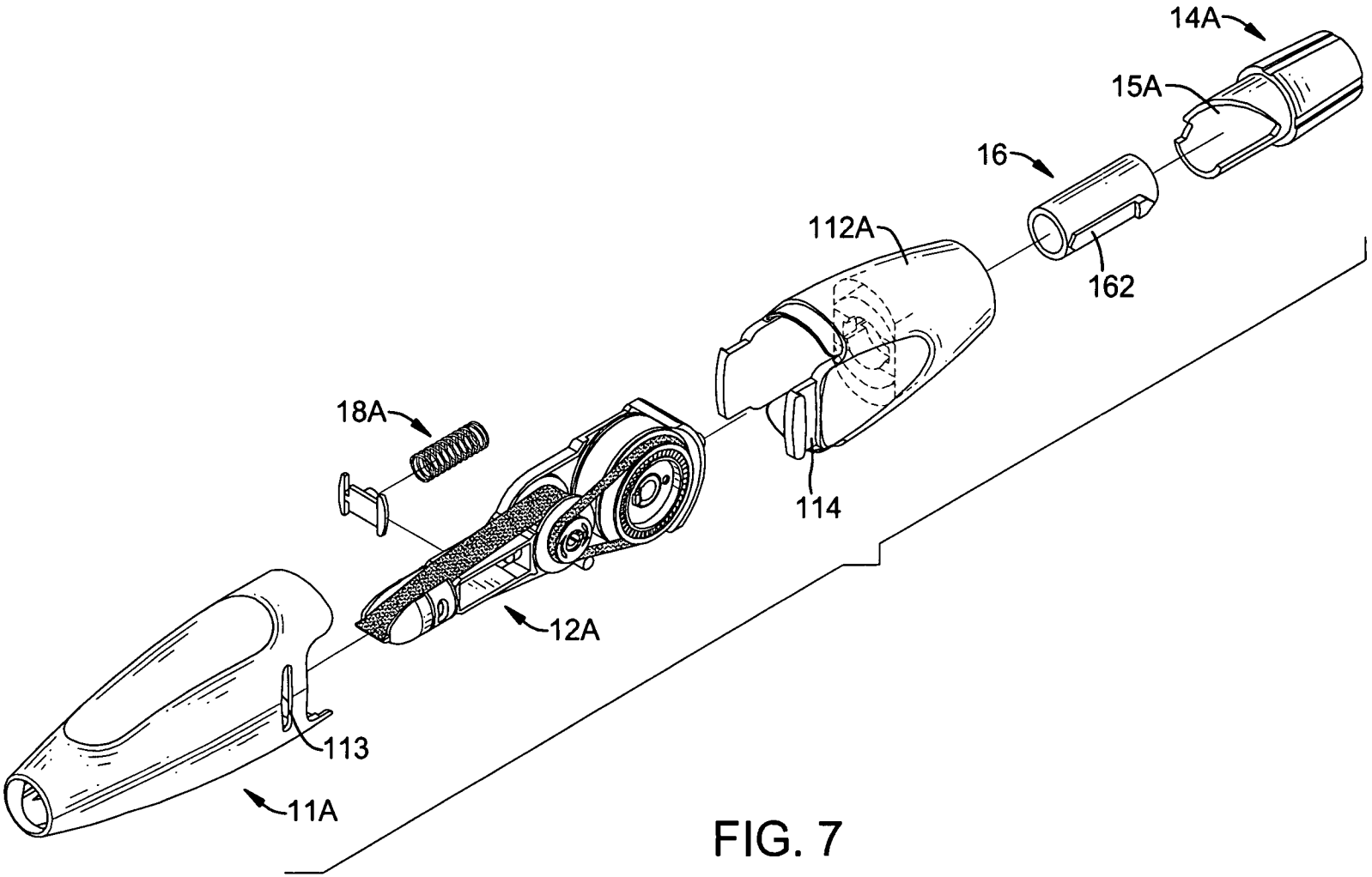
FIG. 7 is an exploded perspective view of the dispenser in FIG. 6.

With reference to FIGS. 6 and 7, in a second embodiment in accordance with the present invention, the body (10A) of the dispenser is composed of a front housing (11A) and a rear housing (112A). The front housing (11A) has multiple connection slots (113) defined in one end of the front housing (11A). The rear housing (112A) has multiple connection hooks (114) formed on one end the rear housing (112A) and engaging respectively the connection slots (113) in the front housing (11A) to detachably combine the front and rear housings (11A, 112A). Accordingly, when the adhesive tape of the dispensing unit (12A) is exhausted, the body (10A) can be detached to replace a new dispensing unit (12A) into the body (10A). In addition, the resilient element (18A) is held in the bracket of the adhesive tape dispensing unit (12A), and a compressing tab is slidably mounted in the bracket, abuts against one end of the resilient element (18A) and is connected securely to the body (10A). When the dispensing unit (12A) is pushed to move, the resilient element (18A) is compressed by the compressing tab and provides a recoil force to the dispensing unit (12A). Furthermore, the knob (14A) may be tubular and has a wall, and the guiding structure (15A) may be a notch, a slot or a concavity defined in the wall of the tubular knob (14A). Accordingly, when the knob (14A) is rotated, the dispensing unit (12A) will be pushed to protrude out of the body (10A) by the pushing element (16) with sliding movement between the guiding and guided structures (15A,162) on the knob (14A) and the pushing element (16). When the knob (14A) is rotated in reverse, the dispensing unit (12A) can be retracted into the body (10A) with the recoil force provided by the resilient element (18A).

Figure 8:
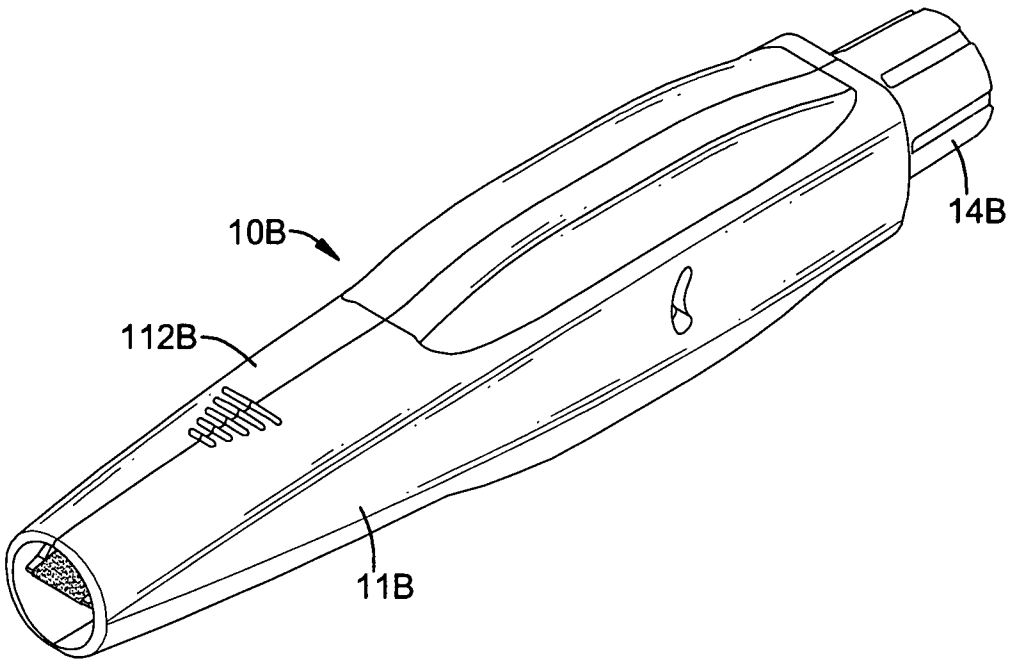
FIG. 8 is a perspective view of a third embodiment of an adhesive tape dispenser in accordance with the present invention.
Figure 9:
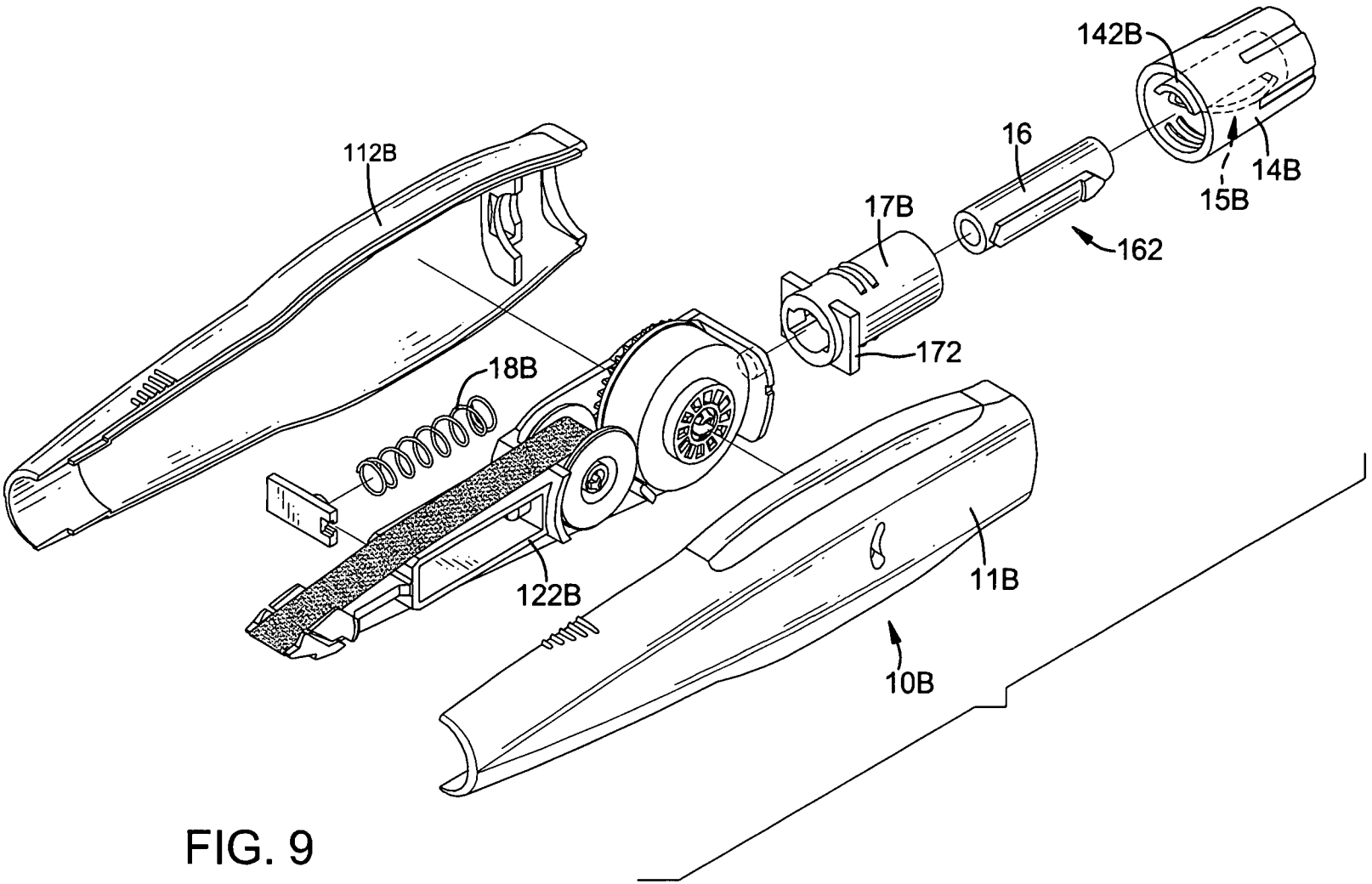
FIG. 9 is an exploded perspective view of the dispenser in FIG. 8.

With reference to FIGS. 8 and 9, in a third embodiment in accordance with the present invention, the body (10B) of the dispenser is composed of two side housings (11B,112B). The knob (14B) may have a guiding tube (142B) on which the guiding structure (15B) is formed. The sleeve (17B) is a separate part from the side housings (11B, 112B) of the body (10B) and has a flange (172) clamped securely between the side housings (11B,112B). The resilient element (18B) is held in the bracket of the dispensing unit (12B) to provide a recoil force to the dispensing unit (12B). The operation of the third embodiment of the dispenser is similar to that of the first or second embodiment and is omitted.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adhesive tape dispenser comprising:

a hollow body having proximal and distal open ends; an adhesive tape dispensing unit removable from and slidably mounted within the body to retractably extend a tape dispensing head thereof from the distal open end of said body;

a detachable housing element having a longitudinal central bore open at both ends and mounted at its proximal end to a rotatable control knob and detachably mounted at its distal end to said proximal open end of said hollow body facing said adhesive tape dispensing unit, said detachable housing element remaining fixed during operation of the dispenser;

said control knob having a guiding element configured with a cam shaped surface oblique to an axis of said control knob and defined along a distal outer facing edge of said guiding element;

a pushing element between said control knob and said adhesive tape dispensing unit, said pushing element traversing the central bore of said housing element and having a follower engaging said cam shaped surface, whereby when said control knob is turned in one direction said follower is directed to move toward the adhesive tape dispensing unit and to cause said adhesive tape dispensing head to extend from the distal open end of the body; and a resilient element mounted in the hollow body to provide a recoil force to the adhesive tape dispensing unit.

2. The adhesive tape dispenser as claimed in claim 1, wherein the guiding element on the control knob is a guiding cavity defined in the control knob.

3. The adhesive tape dispenser as claimed in claim 1, wherein the control knob is hollow and has a cavity defined in an end of the control knob and having a bottom, said guiding element consisting of a portion of an outer edge of a guiding tube formed on and protruding from the bottom of the cavity.

4. The adhesive tape dispenser as claimed in claim 3, wherein the cam-like surface is defined along said outer edge of said guiding tube, said cam-like surface having two positioning recesses each respectively defining one end of the guiding element.

5. The adhesive tape dispenser as claimed in claim 1, wherein the resilient element is a spring, is held in the body and has an end mounted around one end of the adhesive tape dispensing unit.

6. The adhesive tape dispenser as claimed in claim 1 further comprising a sleeve mounted in the body, wherein the pushing element is mounted slidably through the sleeve.

7. An adhesive tape dispenser comprising:

a body consisting of a front housing having a chamber with front and rear open ends, said front housing chamber enclosing an adhesive tape dispensing unit and a tape dispensing head retractably extendable through the front open end;

a rear housing having a chamber therein with front and rear open ends and detachably connected at its front open end with the rear open end of said front housing chamber, said rear housing chamber defining a hollow sleeve therein having an open end concentric with the rear open end of said front housing chamber and facing the adhesive tape dispensing unit;

a knob mounted rotatably on said rear housing chamber and containing an integral guide tube extending concentrically with respect to the rear open end of said rear housing chamber, said guide tube having a distal opening, an edge of the distal opening being configured with a cam shaped guiding surface oblique to the axis of said guide tube, said guiding surface defining two ends each having a limiting capability to restrict a rotating range of the knob relative to the body between the ends of the guiding surface;

a pushing element mounted for slidable engagement within said guide tube and said hollow sleeve, said pushing element having a guided structure connected slidably to slide along the guiding surface on said guide tube when the knob is rotated, whereby rotation of said knob back and forth moves said pushing element through the distal opening of said guide tube and the open end of said hollow sleeve to engage and cause said adhesive tape dispensing unit to move said tape dispensing head to an extended position and to withdraw to permit said tape dispensing head to return to a retracted position; and a resilient element mounted in said front housing chamber to provide a recoil force to bias the adhesive tape dispensing unit and tape dispensing head to a retracted position.

8. The adhesive tape dispenser as claimed in claim 7, wherein the guiding surface on the guide tube obliquely extends 90° to 360° in curvature.

9. The adhesive tape dispenser as claimed in claim 8, wherein the guiding surface on the guide tube obliquely extends 180° to 360° in curvature.

10. The adhesive tape dispenser as claimed in claim 9, wherein the guiding surface on the guide tube obliquely extends 180° in curvature.

11. The adhesive tape dispenser as claimed in claim 7, wherein each of said two ends of said guiding surface has a positioning recess to engage and limit movement of said guided structure along said guiding surface.

12. The adhesive tape dispenser as claimed in claim 7, wherein the body is composed of said front and rear housing chambers combined detachably with each other.

13. The adhesive tape dispenser as claimed in claim 7, wherein the resilient element is a spring and is held by-a portion of the adhesive tape dispensing unit.

14. The adhesive tape dispenser as claimed in claim 13 wherein the resilient element is a spring held in the body and having an end mounted around the tape dispensing head.

15. The adhesive tape dispenser as claimed in claim 7, wherein the resilient element is a spring the front end of which abuts a compressing tab fixed within said front housing chamber and slidably mounted in a bracket containing the spring, such that movement of said tape dispensing head to an extended position compresses the spring to provide a recoil bias to said adhesive tape dispensing unit.

16. The adhesive tape dispenser as claimed in claim 7, wherein said front housing chamber is composed of two side housings combined detachably with each other.

17. The adhesive tape dispenser of claim 16 in which said rear housing comprises a pair of oppositely and outwardly directed flanges adapted to engage corresponding recesses within each of said side housings to clamp said side housings together.

18. The adhesive tape dispenser of claim 7 in which said front housing comprises at least a pair of connection slots defined adjacent the rear open end thereof and said rear housing comprises at least a pair of connection hooks adjacent the front open end thereof, said connection hooks being adapted to engage said connection slots to detachably combine the front and rear housings.

* * * * *